US006325562B2

(12) United States Patent
Gueret

(10) Patent No.: US 6,325,562 B2
(45) **Date of Patent: *Dec. 4, 2001**

(54) MAKE-UP BRUSH AND METHOD FOR MANUFACTURING SUCH A BRUSH

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/754,286

(22) Filed: Jan. 5, 2001

Related U.S. Application Data

(63) Continuation of application No. 08/512,952, filed on Aug. 10, 1995, which is a continuation of application No. 08/179,700, filed on Jan. 11, 1994, now abandoned.

(30) Foreign Application Priority Data

Feb. 8, 1993 (FR) ..... 93 01344

(51) Int. Cl.[7] ..... A46B 11/00

(52) U.S. Cl. ..... 401/129; 401/126; 401/122; 15/206; 15/207

(58) Field of Search ..... 401/121, 122, 401/118, 126, 129; 15/206, 207, 207.2; 300/2, 4, 5, 21

(56) References Cited

U.S. PATENT DOCUMENTS

| | | |
|---|---|---|
| D. 26,619 | 2/1897 | Burnip . |
| 201,688 | 3/1878 | Leiner . |
| D. 250,859 | 1/1979 | Artiano . |

(List continued on next page.)

FOREIGN PATENT DOCUMENTS

| | | |
|---|---|---|
| 145891 | 7/1950 | (AU) . |
| 24654 | 6/1919 | (CH) . |
| 403182 | 6/1966 | (CH) . |
| 27 31 762 | 1/1979 | (DE) . |
| 3415870 A1 | 10/1985 | (DE) . |
| 37 44 868 | 11/1989 | (DE) . |
| 0 202 932 | 11/1986 | (EP) . |
| 2663826 | 3/1992 | (FR) . |
| 2 679 425 | 1/1993 | (FR) . |
| 266937 | 3/1927 | (GB) . |
| 685054 | 12/1952 | (GB) . |
| 2170996 | 8/1986 | (GB) . |
| 450628 | 7/1949 | (IT) . |
| 121822 | 8/1985 | (JP) . |
| 62-127215 | 8/1987 | (JP) . |
| 81018 | 8/1991 | (JP) . |

OTHER PUBLICATIONS

Supplemental Preliminary Amendment filed Jan. 24, 2001, in co–pending U.S application No. 09/754285; Attorney Docket No. 05725.0286–09000.

Co–pending Continuation Application of U.S application No. 08/512,952, including a copy of the Preliminary Amendment filed Jan. 5, 2001 Attorney Docket No. 05725.0286–04000 Title: Make–up Brush and Method for Manufacturing Such A Brush Inventor Jean–Louis H. Gueret U.S. Filing Date: Jan. 5, 2001.

(List continued on next page.)

*Primary Examiner*—David J. Walczak
(74) *Attorney, Agent, or Firm*—Finnegan, Henderson, Farabow, Garrett, & Dunner, L.L.P.

(57) ABSTRACT

The brush (1) includes a core (2) formed from a metal wire bent into a U and the branches of which are twisted to trap radial bristles (3) between them, the core (2) being fixed to the end of a wand (6). The branches of the core are twisted, turning to the left, to form turns which turn in the clockwise direction about the axis (X) of the core when progressing from the wand towards the end of the brush, whereas the bristles (3) of the brush form helical layers (S) rising from left to right in the area located between the core and an observer who holds the brush substantially vertical in front of him/her with its tip pointing upwards.

41 Claims, 2 Drawing Sheets

U.S. PATENT DOCUMENTS

| | | |
|---|---|---|
| D. 270,769 | 9/1983 | Cassai et al. . |
| D. 282,107 | 1/1986 | Cassai et al. . |
| D. 282,605 | 2/1986 | Mu-Jung . |
| D. 282,974 | 3/1986 | Cassai et al. . |
| D. 285,125 | 8/1986 | Cassai et al. . |
| 461,604 | 10/1891 | Dietz . |
| 488,784 | 12/1892 | Zolper . |
| 676,845 | 6/1901 | Leiner . |
| 705,534 | 7/1902 | Klauberg . |
| 748,917 | 1/1904 | Braun . |
| 803,857 | 11/1905 | Roseman . |
| 1,337,819 | 4/1920 | Braun . |
| 1,603,560 | 10/1926 | Skinner . |
| 1,621,900 | 3/1927 | Pretat . |
| 1,656,309 | 1/1928 | Zahoransky . |
| 1,659,707 | 2/1928 | Rudolph . |
| 1,715,387 | 6/1929 | Ralston . |
| 1,762,182 | 6/1930 | Mayer . |
| 1,824,140 | 9/1931 | Hertzberg . |
| 1,902,113 | 3/1933 | Zahoransky . |
| 1,905,399 | 4/1933 | Wagner . |
| 1,909,432 | 5/1933 | Swanson . |
| 1,936,743 | 11/1933 | Zahoransky . |
| 1,996,897 | 4/1935 | Blinn . |
| 2,007,245 | 7/1935 | Gimonet . |
| 2,018,086 | 10/1935 | Parsons . |
| 2,123,044 | 7/1938 | Hertzberg . |
| 2,124,145 | 7/1938 | Merkel, Jr. . |
| 2,141,327 | 12/1938 | Younghusband . |
| 2,148,736 | 2/1939 | Engel, Jr. . |
| 2,184,645 | 12/1939 | Key . |
| 2,189,891 | 2/1940 | Flournoy . |
| 2,230,968 | 2/1941 | Cave . |
| 2,234,641 | 3/1941 | Baumgartner . |
| 2,580,378 | 12/1951 | Peterson et al. . |
| 2,606,338 | 8/1952 | De Lorenzo . |
| 2,627,621 | 2/1953 | Bardugon . |
| 2,690,569 | 10/1954 | Kozerski . |
| 2,712,473 | 7/1955 | Hertberg . |
| 2,829,655 | 4/1958 | Bau . |
| 2,990,834 | 7/1961 | Amen . |
| 3,084,374 | 4/1963 | Ziegler . |
| 3,115,270 | 12/1963 | Melnikoff . |
| 3,191,996 | 6/1965 | Grlardi . |
| 3,214,782 | 11/1965 | Masters et al. . |
| 3,215,472 | 11/1965 | Zahoransky . |
| 3,220,774 | 11/1965 | Logan . |
| 3,241,886 | 3/1966 | Zahoransky et al. . |
| 3,245,554 | 4/1966 | Zahoransky . |
| 3,254,682 | 6/1966 | Gelardi . |
| 3,254,923 | 6/1966 | Marks . |
| 3,306,670 | 2/1967 | Zahoransky . |
| 3,311,416 | 3/1967 | Zahoransky . |
| 3,355,216 | 11/1967 | Zahoransky . |
| 3,365,529 | 1/1968 | Dieffenbach . |
| 3,370,622 | 2/1968 | Marks . |
| 3,640,582 | 2/1972 | Zahoransky . |
| 3,760,449 | 9/1973 | Swanson . |
| 3,817,637 | 6/1974 | Vasas . |
| 3,861,810 | 1/1975 | Vasas . |
| 4,030,199 | 6/1977 | Russell . |
| 4,108,162 | 8/1978 | Chikashige . |
| 4,111,491 | 9/1978 | Steinebrunner et al. . |
| 4,175,574 | 11/1979 | Zulberti . |
| 4,222,143 | 9/1980 | Tarrson et al. . |
| 4,319,377 | 3/1982 | Tarrson et al. . |
| 4,324,084 | 4/1982 | Walter . |
| 4,407,311 | 10/1983 | Gueret . |
| 4,512,810 | 4/1985 | Gahlinger . |
| 4,600,328 | 7/1986 | Clements . |
| 4,603,913 | 8/1986 | Dörflinger et al. . |
| 4,610,481 | 9/1986 | Steinebrunner . |
| 4,617,948 | 10/1986 | Gueret . |
| 4,647,113 | 3/1987 | Steinebrunner . |
| 4,733,425 | 3/1988 | Hartel et al. . |
| 4,861,179 | 8/1989 | Schrepf . |
| 4,886,387 | 12/1989 | Goldberg et al. . |
| 4,887,622 | 12/1989 | Gueret . |
| 4,904,025 | 2/1990 | Steinebrunner et al. . |
| 4,921,366 | 5/1990 | Hurrell . |
| 4,927,281 | 5/1990 | Gueret . |
| 4,961,665 | 10/1990 | Fitjer . |
| 5,063,947 | 11/1991 | Gueret . |
| 5,161,554 | 11/1992 | Fitjer . |
| 5,161,555 | 11/1992 | Cansler . |
| 5,165,760 | 11/1992 | Gueret . |
| 5,197,497 | 3/1993 | Gueret . |
| 5,329,730 | 7/1994 | Scheider et al. . |
| 5,345,644 | 9/1994 | Gueret . |
| 5,431,484 | 7/1995 | Zahoransky et al. . |
| 5,687,446 | 11/1997 | Chen et al. . |
| 5,697,720 | 12/1997 | Lhuisset . |
| 6,099,183 | 8/2000 | Gueret . |

OTHER PUBLICATIONS

Co–pending Continuation Application of U.S application No. 08/512,952, including a copy of the Preliminary Amendment filed Jan. 5, 2001 Attorney Docket No. 05725.0286.05000 Title: Make–up Brush and Method for Manufacturing Such a Brush Inventor: Jean–Louis H. Gueret U.S. Filing Date: Jan. 5, 2001.

Co–pending Continuation Application of U.S. application No. 08/512,952, including a copy of the Preliminary Amendment filed Jan. 5, 2001 Attorney Docket No. 05725.0286–06000 Title: Make–up Brush and Method for Manufacturing Such a Brush Inventor: Jean–Louis H. Gueret U.S. Filing Date: Jan. 5, 2001.

Co–pending Continuation Application of U.S. application No. 08/512,952, including a copy of the Preliminary Amendment filed Jan. 5, 2001 Attorney Docket No. 05725.0286–08000 Title: Make–up Brush and Method for Manufacturing Such a Brush Inventor: Jean–Louis H. Gueret U.S. Filing Date: Jan. 5, 2001.

Co–pending Continuation Application of U.S. application No. 08/512,952, including a copy of the Preliminary Amendment filed Jan. 5, 2001 Attorney Docket No. 05725.0286–09000 Title: Make–up Brush and Method for Manufacturing Such a Brush Inventor: Jean–Louis H. Gueret U.S. Filing Date: Jan. 5, 2001.

Co–pending Continuation Application of U.S. application No. 08/512,952, including a copy of the Preliminary Amendment filed Jan. 5, 2001 Attorney Docket No. 05725.0286–10000 Title: Make–up Brush and Method for Manufacturing Such a Brush Inventor: Jean–Louis H. Gueret U.S. Filing Date: Jan. 5, 2001.

Co–pending Continuation Application of U.S. application No. 08/512,952, including a copy of the Preliminary Amendment filed Jan. 5, 2001 Attorney Docket No. 05725.0286–11000 Title: Make–up Brush and Method for Manufacturing Such a Brush Inventor: Jean–Louis H. Gueret U.S. Filing Date: Jan. 5, 2001.

Co–pending Continuation Application of U.S. application No. 08/512,952, including a copy of the Preliminary Amendment filed Jan. 5, 2001 Attorney Docket No. 05725.0286–01000 Title: Make–up Brush and Method for Manufacturing Such a Brush Inventor: Jean–Louis H. Gueret U.S. Filing Date: Aug. 10, 1995.

MAKE-UP BRUSH AND METHOD FOR MANUFACTURING SUCH A BRUSH

This is a continuation application Ser. No. 08/512,952, filed Aug. 10, 1995, which is a continuation of application Ser. No. 08/179,700, filed Jan. 11, 1994 (abandoned).

The invention relates to a make-up brush, particularly for applying mascara to the eyelashes, of the type of those which include a core formed from a metal wire bent into a U and the branches of which are twisted to trap radial bristles between them, the core being fixed at the end of a stem.

A brush of this type is shown, for example, by FR-A-2, 663,826.

When making-up, the user holds the stem of the brush forming a non-zero angle with respect to the mean transverse line of the two eyes. As a result, with conventional brushes known to date, the user frequently offers up the bristles of the brush in alignment with the eyelashes and deposits blobs of mascara, without separating the eyelashes. The make-up effect obtained therefore needs to be improved.

Furthermore, the brush is generally placed in a container containing the mascara, this container being equipped with a neck provided with a wiper through which the brush passes. It is desirable for it to be possible for wiping to take place with lower resistance, giving a better smoothing of the product along the bristles.

The object of the invention, above all, is to provide a make-up brush, particularly for applying mascara to the eyelashes, which no longer exhibits the drawbacks recalled above, or exhibits them to a lesser degree.

According to the invention, a make-up brush of the sort defined previously is characterized in that the branches of the core are twisted, turning to the left, to form turns which, viewed along the axis of the core from that end which is fixed in the stem, turn in the clockwise direction about the axis of the core when progressing from the stem towards the end of the brush, whereas the bristles of the brush form helical layers rising from left to right in the area located between the core and an observer who holds the substantially vertical brush in front of him/her with its tip pointing upwards.

Preferably, the angle of inclination of the layers of bristles with respect to the axis is approximately 35°.

In general, the stem carrying the core includes, at its end distant from the core, a cap provided with a screw thread for screwing onto the neck of a container containing the mascara, this neck being equipped with a wiper device through which the brush passes when it is withdrawn from the container; according to the invention, the branches of the core of the brush are twisted to form turns turning in the same direction as the screw thread of the cap.

In practice, the direction of screwing of the cap relative to the container is the clockwise direction, and the branches of the core are twisted so that the turns turn in the clockwise direction about the axis of the core when progressing from that part of the core which is fixed in the stem towards the free end of the core.

Thus, the rotational movement for unscrewing the cap relative to the neck takes place in the same direction as the rotational movement which unscrews the brush relative to the wiper.

The invention also relates to a method for manufacturing a make-up brush, according to which method, after having folded a metal wire over into a U, and after having placed bristles between the branches of the U, the branches of the U are twisted by turning the bent part of the U in the counterclockwise direction relative to the free ends of the branches.

For shaping the bristles of the brush the direction of rotation of the brush and the direction of rotation of a trimmer are reversed with respect to the usual direction of rotation.

The invention consists, apart from the arrangements expounded hereinabove, of a certain number of other arrangements which will be dealt with more fully later with regard to embodiments which are described with reference to the drawings appended hereto but which are in no way limiting.

FIG. 1 of these drawings is a diagram illustrating the making-up of the eyelashes with a brush in accordance with the prior art.

Figure 9:
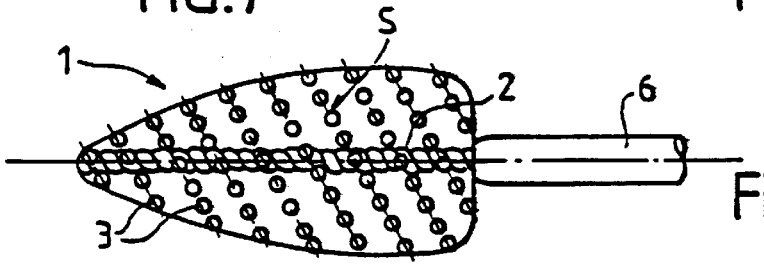

FIG. 9, finally, is a diagram of a variant embodiment of the brush.

Figure 1:
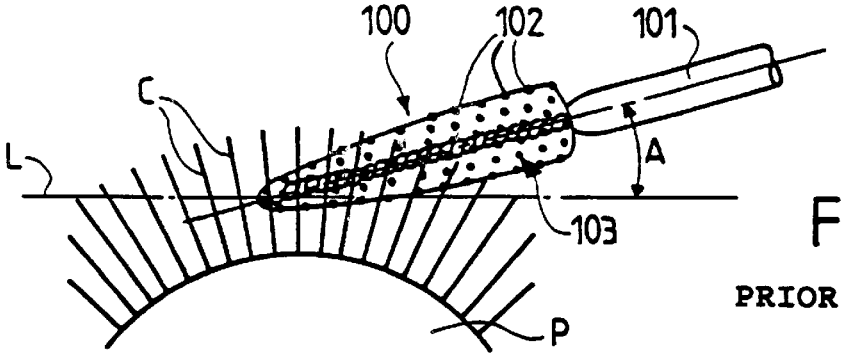
FIG. 1 PRIOR ART

Referring to FIG. 1 of the drawings, a diagram can be seen illustrating a making-up operation using a brush 100 of the prior art, carried by a stem 101. The eyelid P of the right eye is viewed from above. The user holds the stem 101 in her right hand forming an angle A between the axis of the stem and a line L parallel to the mean transverse line of the two eyes. The angle A is, in practice, of the order of 10 to 15°. In the conventional brush 100, the bristles 102 form layers 103 in a helix which, for an observer holding the brush 100 vertically in front of him/her, with its end pointing upwards, rise from right to left in the area lying between the observer and the axis of the brush.

With such an arrangement, as visible in FIG. 1, eyelashes C are practically aligned with the layers 103 of bristles of the brush. As a result blobs of mascara are deposited on the eyelashes without these being separated by brushing. The resulting make-up effect needs to be improved.

Figure 3:
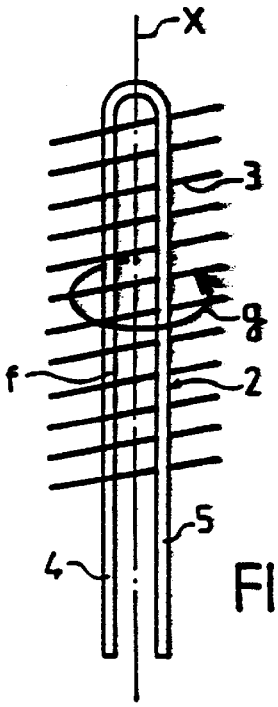
FIGS. 3 and 4 are diagrams illustrating phases of manufacturing the core of a brush according to the invention.

To do that, according to the invention, a mascara brush 1 includes a core 2 formed from a metal wire f bent into a U conventionally as illustrated in FIG. 3, the bristles 3 being arranged between the branches 4, 5 of the U, substantially perpendicularly to the plane of these branches 4 and 5. The said branches 4 and 5 are then twisted by turning to the left, that is to say in the counterclockwise direction, the bent-over end of the U with respect to the free ends of the branches. This twisting movement is illustrated by an arrow g in FIG. 3.

Figure 4:
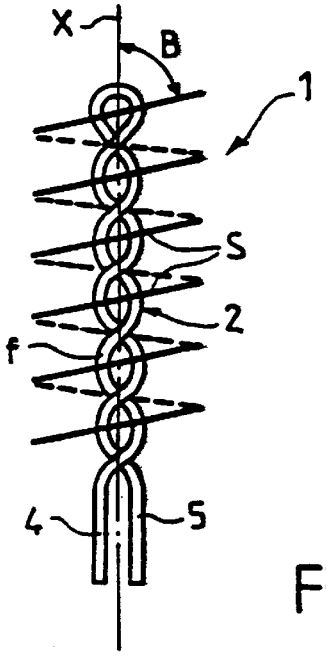
Figure 5:
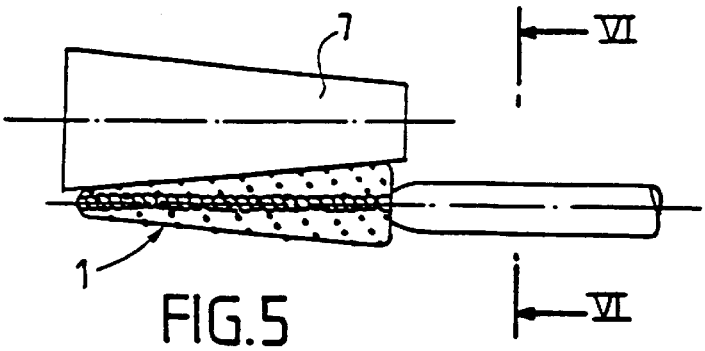
FIG. 5 is a diagram illustrating the cutting of the bristles of the brush.
Figure 6:
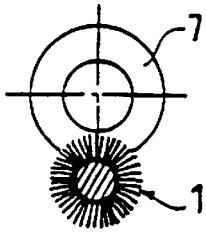
FIG. 6 is a diagrammatic view along the line VI—VI of FIG. 5.

To show the turns obtained clearly, FIG. 4 represents the branches 4, 5 twisted partially, the turns not yet being substantially adjoining. When the core is finished, as illustrated in FIG. 2, the turns are practically adjoining, gripping the bristles 3 between them.

Figure 2:
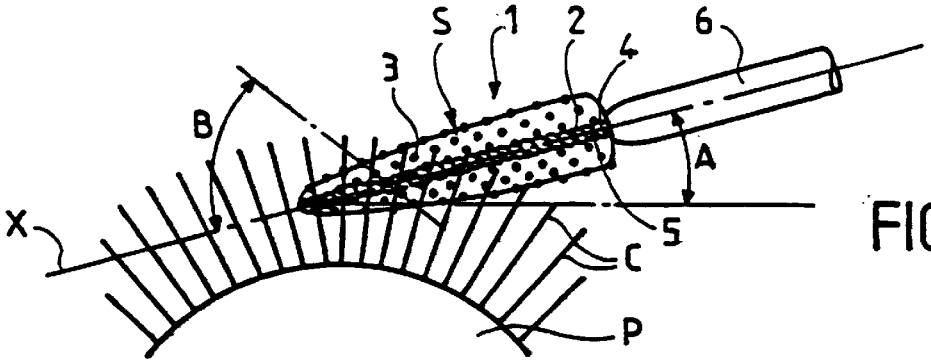
FIG. 2 is a diagram similar to that of FIG. 1 illustrating making-up with a brush in accordance with the invention.

It appears from FIGS. 2 and 4 that the turns of tne core 2, viewed along the axis X from the free ends of the branches 4, 5 which are intended to be fixed in the stem, turn in the clockwise direction about the axis X of the core when progressing from the free end of the branches 4, 5 towards the opposite end of the core. The bristles 3 of the brush form helical layers S rising from left to right in an area located between the core and an observer who holds the brush substantially vertical in front of him/her with its tip pointing upwards. To illustrate this direction of rise of the layers S clearly, the layers which are located to the front of the plane of the drawing have been represented in solid line, whereas those which are located to the rear of the plane have been represented in dashes.

The mean angle of inclination B of the layers S with respect to the axis of the core 2 depends on the pitch of the turns of the core 2.

With a brush 1 in accordance with the invention, in which the turns are reversed with respect to a conventional brush, during making-up, as illustrated in FIG. 2, the eyelashes C are offered up transversely to the layers S of bristles, which has the effect of depositing the make-up product more homogeneously, and above all, of separating the eyelashes C right from the start. With the same angle A of approximately 15°, the eyelashes C are at substantially 70° across the layers S for an angle B of approximately 35°.

The bristles 3, when they are placed between the branches 4, 5 of the U, as illustrated in FIG. 3, generally have the same length and their ends are aligned, the middle of the bristles being substantially on the axis of the core. As a result, after twisting the branches 4, 5, the envelope surface of the ends of the bristles is a cylindrical surface, axisymmetric about the axis X of the core. In general, the brush 1 is given a shape which is different from the cylindrical shape, for example a cone frustum shape tapered towards that end which is distant from the stem.

To do that, a trimmer 7 is used, for example of cone frustum shape, of axis parallel to that of the core, but pointing in the opposite direction. During the cutting operation, the brush 1 and the trimmer 7 are made to turn about their respective axis. Owing to the reversal of the direction of the turns, with respect to a conventional brush, the brush and the trimmer are made to rotate in a direction which is the reverse of that adopted for cutting a conventional brush.

Figure 7:
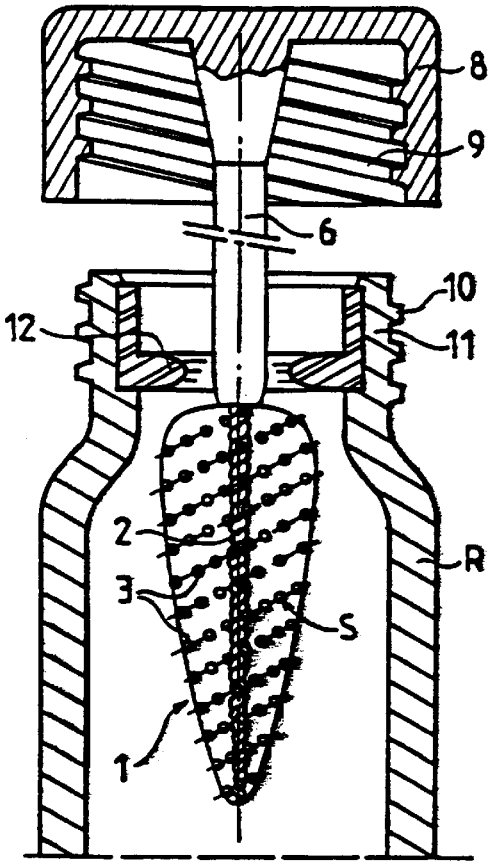
FIG. 7 is a diagrammatic section illustrating the beginning of taking a brush according to the invention out of its mascara container.
Figure 8:
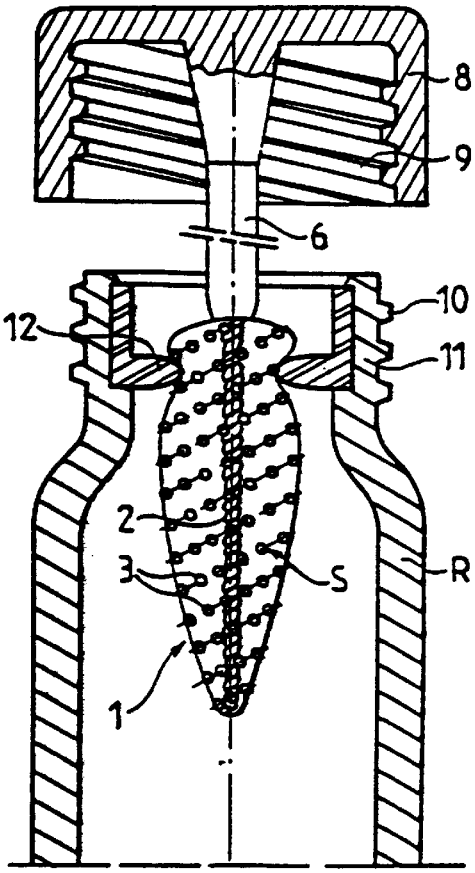
FIG. 8 illustrates the passage of the brush according to the invention through the wiper.

The brush 1 generally includes, at that end of the wand 6 which is remote from the core 2, a stopper 8 (see FIGS. 7 and 8) equipped with an internal screw thread 9 for screwing onto the external screw thread 10 of the neck 11 of a container R containing the mascara. The container according to an optional embodiment may contain a non-solid mascara product. This neck 11 is provided, internally, with a wiper 12 generally consisting of a sort of washer made from a flexible material, particularly from an elastomeric material; the diameter of the internal orifice of the wiper 12 is only slightly greater than that of the wand 6, so that passing through this wiper 12 takes place with a certain resistance developed by the bristles 3, which must fold at least partially.

According to the invention, the turns of the core 2 of the brush and the layers S of bristles turn about the axis of the stem 6 in the same direction as the internal screw thread 9 of the cap 8 and as the external screw thread 10 of the neck 11.

When the brush 1 is extracted from the container R, the user first of all exerts a rotational movement on the cap 8 to unscrew it from the neck 11. This rotational movement takes place in an counterclockwise direction. When the cap 8 is unscrewed, the user terminates the extraction by exerting a translational movement. In practice, this translational movement is accompanied by a rotational movement in the same direction as the one which caused the unscrewing of the cap 8.

Owing to the fact that the layers S of the brush 1 turn in the same direction as the screw thread 9, the negotiation of the wiper 12 by the layers S, which are given a rotational movement in the counterclockwise direction, corresponds to unscrewing the brush 1 with respect to the wiper 12, which reduces the resistance offered by the bristles 3 when passing through the wiper 12.

The bristles 3 of the brush, resisting the wiper to a lesser extent, create less of a partial vacuum, and therefore less of a pressure effect during extraction. The product is better distributed along the bristles, and the bristles apply the product with better smoothness along the eyelashes C.

The pitch of the turns of the core 2 may be chosen to be different from the pitch of the screw thread 9, to modulate the wiping through the wiper 12.

Numerous variant embodiments of the brush 1 are possible. FIG. 9 illustrates a slightly different form of brush produced with bristles of larger cross-section and where a smaller number per turn is used. The brush may include an off-centered core.

The brush could include a mixture of bristles of different cross-sections. The bristles may include longitudinal capillary slits or grooves. The bristles may be tubular.

The transverse section of the bristles 3 may have different shapes: circular, oval, multilobed, rectangular, flat, etc.

The ends of the bristles may be jagged or include a bulge. The bristles may be formed from a mixture of relatively rigid bristles and more flexible bristles.

In the case of a mixture of bristles of different diameter, the bristles of large diameter may be longer or shorter than those of smaller diameter. The bristles are made of a conventional thermoplastic material such as polyamides, polyesters, polyether-block-amides or polytetrafluoroethylene. These thermoplastic materials may contain additives changing the wettability of these bristles or their slip characteristics. These additives are chosen from among molybdenum sulphide, boron nitride, or the product marketed under the trade name "Teflon", fullerenes, graphite, talc or similar materials.

What is claimed is:

1. A device for application of non-solid mascara product, comprising:

a non-solid mascara product; and a brush having a twisted wire core having branches forming helical turns about an axis of said core and holding layers of radially extending bristles, wherein, when an observer views the brush substantially vertically from the front, the helical turns rise from the left to the right, said device further including a receptacle containing the non-solid mascara product.

2. The device of claim 1, further comprising a cap attached to the brush and being configured to removably engage the receptacle to open and close the receptacle.

3. The device of claim 2, wherein said bristles include bristles having differing diameters.

4. The device of claim 2, wherein the cap is configured to be moved from a closed position on the receptacle by turning the cap in a counterclockwise direction.

5. The device of claim 2, wherein the cap is provided with internal screw threading configured to removably engage an externally threaded portion of the receptacle.

6. The device of claim 5, wherein the helical turns of the brush turn in the same direction as the screw threading.

7. The device of claim 5, wherein a pitch of the screw threading differs from a pitch of the helical turns.

8. The device of claim 1, wherein the receptacle includes a wiper through which the brush is adapted to pass.

9. The device of claim 1, wherein the brush is a brush for applying mascara to eyelashes.

10. The device of claim 1, wherein said bristles comprise bristles having differing flexibilities.

11. The device of claim 1, wherein said bristles have transverse sections selected from circular, oval, multi-lobed, rectangular, and flat shapes.

12. A device for storing and applying non-solid mascara, comprising:

a non-solid mascara;

a container containing the non-solid mascara and including an open end; and a stem, one end of said stem being attached to a cap and the other end being attached to a brush for applying the non-solid mascara configured to be, said cap being adapted to close said open end when said brush is inserted into said container through said open end, said container being equipped with a wiper located in the vicinity of said open end of said container for wiping said brush when it is withdrawn from the container, and wherein said brush comprises a twisted wire core having branches forming helical turns about an axis of said core and holding layers of radially extending bristles, and further wherein, when an observer views the brush substantially vertically from the front, the helical turns rise from the left to the right.

13. The device of claim 12, wherein the cap includes internal screw threading configured to removably engage an externally threaded portion of the container to open and close the open end of the container.

14. The device of claim 13, wherein the helical turns of the brush turn in the same direction as the screw threading.

15. The device of claim 13, wherein a pitch of the screw threading differs from a pitch of the helical turns.

16. The device of claim 12, wherein the cap is configured to open the open end for the container by turning the cap in a counterclockwise direction.

17. The device of claim 12, wherein the brush is a brush for applying mascara to eyelashes.

18. The device of claim 12, wherein said bristles comprise bristles having differing flexibilities.

19. The device of claim 12, wherein said bristles have transverse sections selected from circular, oval, multi-lobed, rectangular, and flat shapes.

20. The device of claim 12, wherein said bristles comprise bristles having differing diameters.

21. A mascara application system comprising:

a non-solid mascara;

a container containing the non-solid mascara; and for insertion into said container, a brush for applying the non-solid mascara comprising a twisted wire core having branches forming helical turns about an axis of said core and holding layers of radially extending bristles, wherein, when an observer views the brush substantially vertically from the front, the helical turns rise from the left to the right.

22. The system of claim 21, further comprising a cap attached to the brush and being configured to removably engage the container to open and close the container.

23. The system of claim 22, wherein the cap is configured to be moved from a closed position on the container by turning the cap in a counterclockwise direction.

24. The system of claim 23, wherein the container includes a wiper through which the brush is adapted to pass as the cap is removed from the container.

25. The system of claim 23, wherein the brush is for applying mascara to eyelashes.

26. The system of claim 22, wherein the cap is provided with internal screw threading configured to removably engage an externally threaded portion of the container.

27. The system of claim 26, wherein the helical turns of the brush turn in the same direction as the screw threading.

28. The system of claim 26, wherein a pitch of the screw threading differs from a pitch of the helical turns.

29. The system of claim 21, wherein the bristles comprise bristles having differing flexibilities.

30. The system of claim 21, wherein said bristles have transverse sections selected from circular, oval, multi-lobed, rectangular, and flat shapes.

31. The system of claim 21, wherein said bristles comprise bristles having differing diameters.

32. A method of making up the eyelashes, comprising:

providing a non-solid mascara;

loading with the non-solid mascara radially extending bristles of a mascara brush comprising a twisted wire core having branches forming helical turns about an axis of said core and holding layers of said radially extending bristles, wherein, when an observer views the brush substantially vertically from the front, the helical turns rise from the left to the right;

bringing said loaded brush into engagement with said eyelashes; and passing said engaged brush through the eyelashes.

33. The method of claim 32, further comprising a cap attached to the brush and being adapted to removably engage a container containing the non-solid mascara, the method further comprising removing the cap from the container.

34. The method of claim 33, further comprising passing the brush through a wiper.

35. The method of claim 33, wherein the removing of the cap includes rotating the cap in a counterclockwise direction.

36. The method of claim 33, wherein the cap is provided with internal screw threading adapted to removably engage an externally threaded portion of the container.

37. The method of claim 36, wherein the helical turns of the brush turn in the same direction as the screw threading.

38. The method of claim 36, wherein a pitch of the screw threading differs from a pitch of the helical turns.

39. The method of claim 32, wherein the bristles include bristles having differing flexibilities.

40. The method of claim 32, wherein the bristles include bristles having transverse sections selected from circular, oval, multi-lobed, rectangular, and flat shapes.

41. The method of claim 32, wherein the bristles include bristles having differing diameters.

* * * * *

UNITED STATES PATENT AND TRADEMARK OFFICE

CERTIFICATE OF CORRECTION

PATENT NO. : 6,325,562 B2
DATED : December 4, 2001
INVENTOR(S) : Jean-Louis H. Gueret It is certified that error appears in the above-identified patent and that said Letters Patent is hereby corrected as shown below:

Column 5, claim 16,
Line 34, replace "for the container" with -- of the container --.

Signed and Sealed this

Nineteenth Day of March, 2002

*Attest:*

*Attesting Officer*

JAMES E. ROGAN
*Director of the United States Patent and Trademark Office*